US008041242B2

(12) United States Patent
Shin

(10) Patent No.: US 8,041,242 B2
(45) Date of Patent: Oct. 18, 2011

(54) IMAGE FORMING APPARATUS AND IMAGE FORMING METHOD THEREOF

(75) Inventor: Dong-myong Shin, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 71 days.

(21) Appl. No.: 12/267,700

(22) Filed: Nov. 10, 2008

(65) Prior Publication Data

US 2009/0136248 A1 May 28, 2009

(30) Foreign Application Priority Data

Nov. 22, 2007 (KR) ..... 10-2007-0119887

(51) Int. Cl.
*G03G 13/08* (2006.01)

(52) U.S. Cl. ..... 399/54

(58) Field of Classification Search ..... 399/54; 358/3.12, 3.1, 3.02
See application file for complete search history.

(56) References Cited

U.S. PATENT DOCUMENTS

| | | | | |
|---|---|---|---|---|
| 5,648,801 | A * | 7/1997 | Beardsley et al. | 347/15 |
| 5,896,207 | A * | 4/1999 | Tomida | 358/537 |
| 6,343,194 | B1 * | 1/2002 | Shimada | 399/28 |
| 2005/0219602 | A1 * | 10/2005 | Mikami | 358/1.14 |
| 2006/0209347 | A1 * | 9/2006 | Nagaishi et al. | 358/3.12 |

* cited by examiner

*Primary Examiner* — Constantine Hannaher
(74) *Attorney, Agent, or Firm* — Stanzione & Kim, LLP

(57) ABSTRACT

A method of forming an image with a plurality of colors of developer, the method including generating color printing data corresponding to colors, sensing remainders of the plurality of colors of developer, converting the color printing data into mono printing data for a reference color corresponding to color density of each color printing data if at least one of colors of developer is insufficient, and printing the mono printing data.

17 Claims, 9 Drawing Sheets

FIG. 4A

| COLOR | PRINTING DATA | PULSE SIGNAL | SIZE OF PRINTING DOT |
|---|---|---|---|
| K | 1000001 | | $r_k$ |
| C | 0011001 | | $r_c$ |
| M | 0101001 | | $r_m$ |
| Y | 0100101 | | $r_y$ |

IMAGE FORMING APPARATUS AND IMAGE FORMING METHOD THEREOF

CROSS-REFERENCE TO RELATED APPLICATIONS

This application claims priority under 35 U.S.C. §119(a) from Korean Patent Application No. 10-2007-0119887, filed on Nov. 22, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus and an image forming method, and more particularly to an image forming apparatus to convert color printing data into mono printing data when any one of colors of developer is used up, and an image forming method thereof.

2. Description of the Related Art

In general, an image forming apparatus forms a latent image on an image carrying body, charged at predetermined electric potential, through exposure and develops the latent image with a developer having a predetermined color. Then, the developed image is transferred and fused on a print medium, thereby printing an image.

As network technology becomes advanced, the image forming apparatus has recently been used while being connected to a plurality of host systems through network. Further, to process a plurality of image data transmitted from the plurality of host systems, the image processing apparatus has increased in printing speed.

FIG. 1 is a schematic diagram of a printing procedure in a conventional image forming apparatus. As illustrated therein, the conventional image forming apparatus (P) receives printing signals from a plurality of host systems h1, h2, h3 via communications network N and converts image data of the printing signals into printing data to be printable. The converted printing data forms a queue of printing jobs (pj) and is then printed on a print medium in sequence.

However, in the conventional image forming apparatus, if any one of colors of developer remains less than the amount required for color printing, the printing jobs are not smoothly printed. In other words, if a magenta developer is substantially used up while the printing job for first printing data a in printing job queue pj is printed as illustrated in FIG. 1, the color printing for second color printing data b may not be performed as desired.

At this time, the conventional image forming apparatus informs a user that the magenta developer is used up and allows a user to select whether or not to cancel the printing job for the second color printing data b being processed and whether to change the color printing to mono printing or not.

Meanwhile, there has been a problem that the printing job for third color printing data c following that for the second color printing data b may be delayed until the printing job for the second color printing data b is completed. However, a user of a third host system that outputs the printing signal for the third color printing data c cannot know why the printing job for the third color printing data c is delayed.

Further, even though a user of a second host system cancels the printing job for the second color printing data b, the printing data converted from the image data is not printed and still remains in a memory, thereby wastefully occupying the memory.

Also, when a user wants the second color printing data b, of which the printing job is canceled, to be printed as a mono image in one color such as black, the converted color printing data is unusable for the image forming apparatus and thus deleted. Accordingly, the host system has to output a new printing signal for the mono image to the image forming apparatus. If mono image data of the new printing signal is converted into fourth printing data b, the fourth printing data b is printed after all printing jobs waiting to be printed are completed, thereby making the user wait for a relatively long time.

SUMMARY OF THE INVENTION

Accordingly, it is an aspect of the present general inventive concept to provide an image forming apparatus and an image forming method thereof, in which, if any one of colors of developer is insufficient after preparing color printing data, the prepared color printing data is converted into mono printing data, thereby increasing printing speed and providing convenience to a user.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a method of forming an image with a plurality of colors of developer, the method including generating color printing data corresponding to colors, sensing remainders of the plurality of colors of developer, converting the color printing data into mono printing data for a reference color corresponding to color density of each color printing data if at least one of colors of developer is insufficient, and printing the mono printing data.

The converting the color printing data into the mono printing data may include dividing a pulse signal of each color printing data with respect to the pulse signal of the reference color.

The pulse signal of the color printing data may be divided by as many as a multiple of the plurality of colors of developer.

The method may further include converting the pulse signal of each color of developer into one of the divided pulse signals such that the plurality of colors of developer have one or more different pulse signals.

The method may include that the higher multiple the divided pulse signals may correspond to, the more colors the mono printing data represents.

The method may further include displaying a multiple for dividing the pulse signal.

The method may include comprise changing the multiple for dividing the pulse signal.

The mono printing data may be converted to have the pulse signal decreased in an order of black, cyan, magenta and yellow.

The foregoing and/or other aspects and utilities of the present general inventive concept may also be achieved by providing an image forming apparatus, the apparatus including a plurality of developing units which are different in color and comprises a photosensitive body and a developer storage to form an image on a print medium, a developer remainder sensor which senses a remainder of each color of developer in the developing unit, an image processor which converts color image data of a printing signal into a plurality of color printing data to be printable, and converts the plurality of color printing data into mono printing data for mono color, a light scanning unit which scans the photosensitive body with light according to printing data generated by the image processor, and a controller which controls the image processor to convert the color printing data into mono printing data for a reference color corresponding to color density of each color printing data if the developer remainder sensor senses that the remainder of developer in at least one of the developer units is insufficient.

The image processor of the apparatus may adjust a pulse signal of the color printing data to have different print densities for colors when the plurality of color printing data is converted into mono printing data for a reference color.

The image processor of the apparatus may convert the mono printing data to have various pulse signals with respect to a pulse signal for a reference color.

The pulse signal may be decreased in an order of black, cyan, magenta and yellow.

The pulse signal may be divided by as many as a multiple of the plurality of colors of developer.

The higher multiple the divided pulse signals may correspond to, the more colors the mono printing data represents.

The foregoing and/or other aspects and utilities of the general inventive concept may also be achieved by providing a method of forming an image with a plurality of colors of developer, the method including receiving first printing signals and second printing signals from at least one host system, converting the first printing signals into first color printing data and the second printing signals into second color print data, sensing the remainder of at least one of the plurality of colors of developer, converting the first color printing data into first mono printing data for a reference color corresponding to color density of each color printing data if at least one of colors of developer is insufficient, printing the first mono printing data, and automatically converting the second color print data into second mono printing data and printing the second mono printing data.

The foregoing and/or other aspects and utilities of the general inventive concept may also be achieved by providing a method of forming an image with a plurality of colors of developer, the method including receiving printing signals from at least one host system and converting the data into color printing data, sensing remainders of the plurality of colors of developer, automatically converting the color printing data into mono printing if at least one of colors of developer is insufficient, and printing the mono printing data.

The foregoing and/or other aspects and utilities of the general inventive concept may also be achieved by providing a computer-readable recording medium having recorded thereon a program to implement a method of forming an image with a plurality of colors of developer, the method including generating color printing data corresponding to colors, sensing remainders of the plurality of colors of developer, converting the color printing data into mono printing data for a reference color corresponding to color density of each color printing data if at least one of colors of developer is insufficient, and printing the mono printing data.

The foregoing and/or other aspects and utilities of the general inventive concept may also be achieved by providing a computer-readable recording medium having recorded thereon a program to implement a method of forming an image with a plurality of colors of developer, the method including receiving first printing signals and second printing signals from at least one host system, converting the first printing signals into first color printing data and the second printing signals into second color print data, sensing the remainder of at least one of the plurality of colors of developer, converting the first color printing data into first mono printing data for a reference color corresponding to color density of each color printing data if at least one of colors of developer is insufficient, printing the first mono printing data, and automatically converting the second color print data into second mono printing data and printing the second mono printing data.

The foregoing and/or other aspects and utilities of the general inventive concept may also be achieved by providing a computer-readable recording medium having recorded thereon a program to implement a method of forming an image with a plurality of colors of developer, the method including receiving printing signals from at least one host system and converting the data into color printing data, sensing remainders of the plurality of colors of developer, automatically converting the color printing data into mono printing if at least one of colors of developer is insufficient, and printing the mono printing data.

The foregoing and/or other aspects and utilities of the general inventive concept may also be achieved by providing an image forming apparatus, including a sensor to sense a first amount of a first color developer and a second amount of a second color developer, and a controller to convert color print data to mono print data according to at least one of the first amount and the second amount.

The image forming apparatus may include a developing unit to form an image on a print media using the other one of the first color developer and the second color developer.

The controller of the image forming apparatus may receive the color part data from an external host device, and converts the color print data into mono print data without communicating with the external host device.

The foregoing and/or other aspects and utilities of the general inventive concept may also be achieved by providing a method of forming an image, the method including sensing a first amount of a first color developer and a second amount of a second color developer, and converting color print data to mono print data according to at least one of the first amount and the second amount.

The method may include forming an image on a print media using the other one of the first color developer and the second color developer.

The method may include receiving the color part data from an external host device, and converting the color print data into mono print data without communicating with the external host device.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings, in which:

FIGS. 4A and 4B illustrate color printing data generated in an image processor of the image forming apparatus according to an exemplary embodiment of the present general inventive concept;

DETAILED DESCRIPTION OF THE PREFERRED EMBODIMENTS

Figure 1:
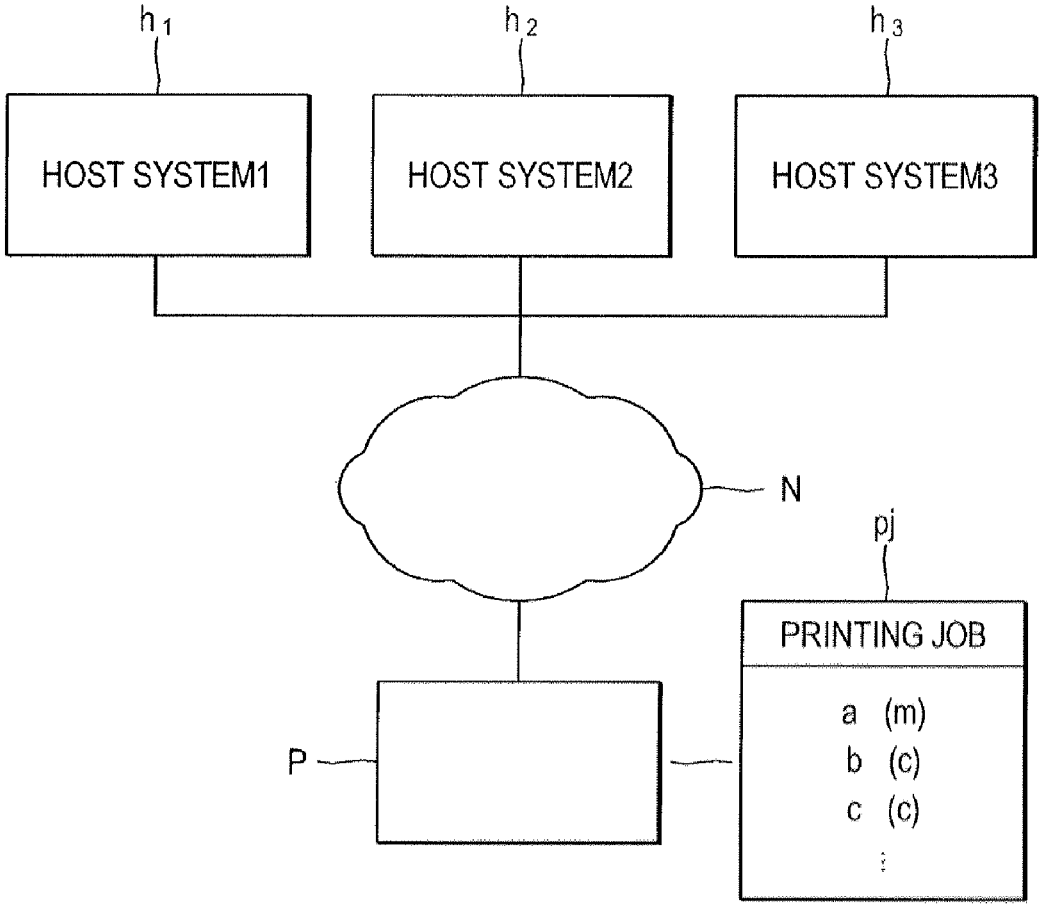
FIG. 1 (RELATED ART)
FIG. 1 illustrates a printing procedure of a conventional image forming apparatus.

Reference will now be made in detail to the embodiments of the present general inventive concept, examples of which are illustrated in the accompanying drawings, wherein like reference numerals refer to like elements throughout. The embodiments are described below so as to explain the present general inventive concept by referring to the figures.

Figure 2:
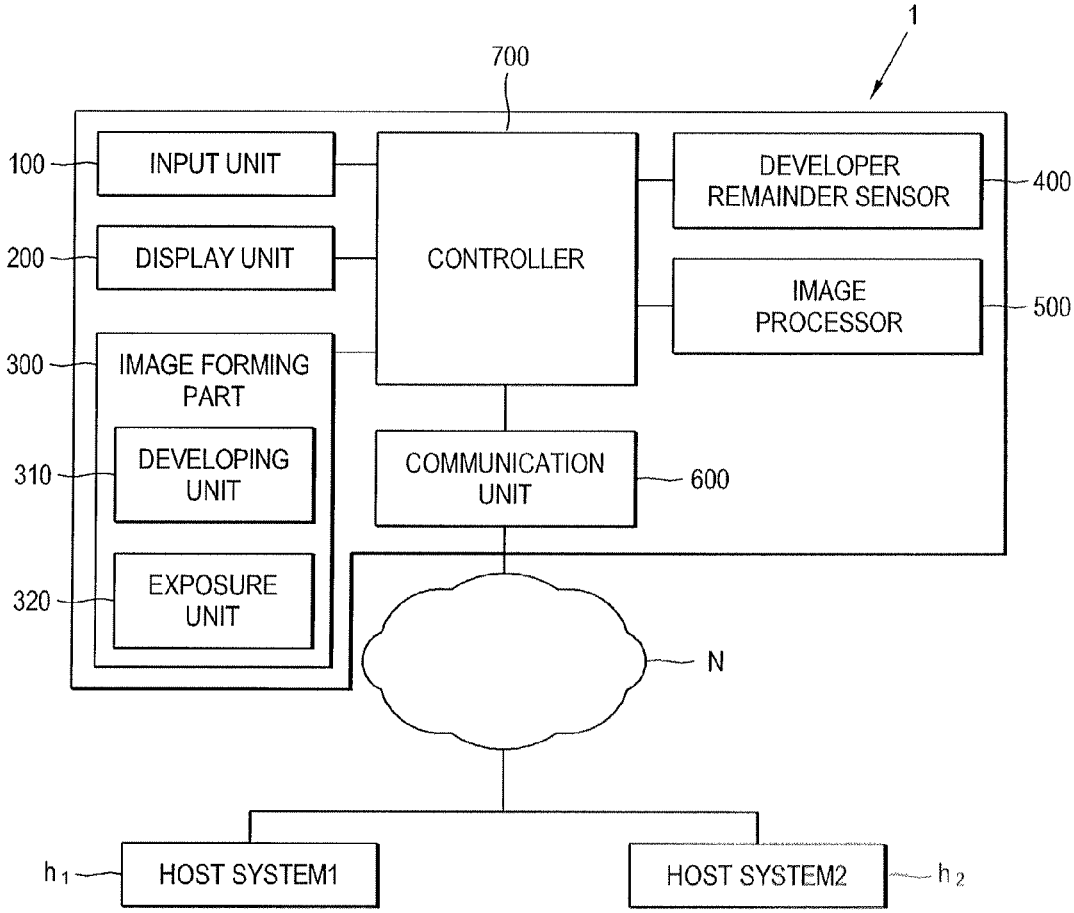
FIG. 2 is a block diagram illustrating a configuration of an image forming apparatus according to an exemplary embodiment of the present general inventive concept.
Figure 3:
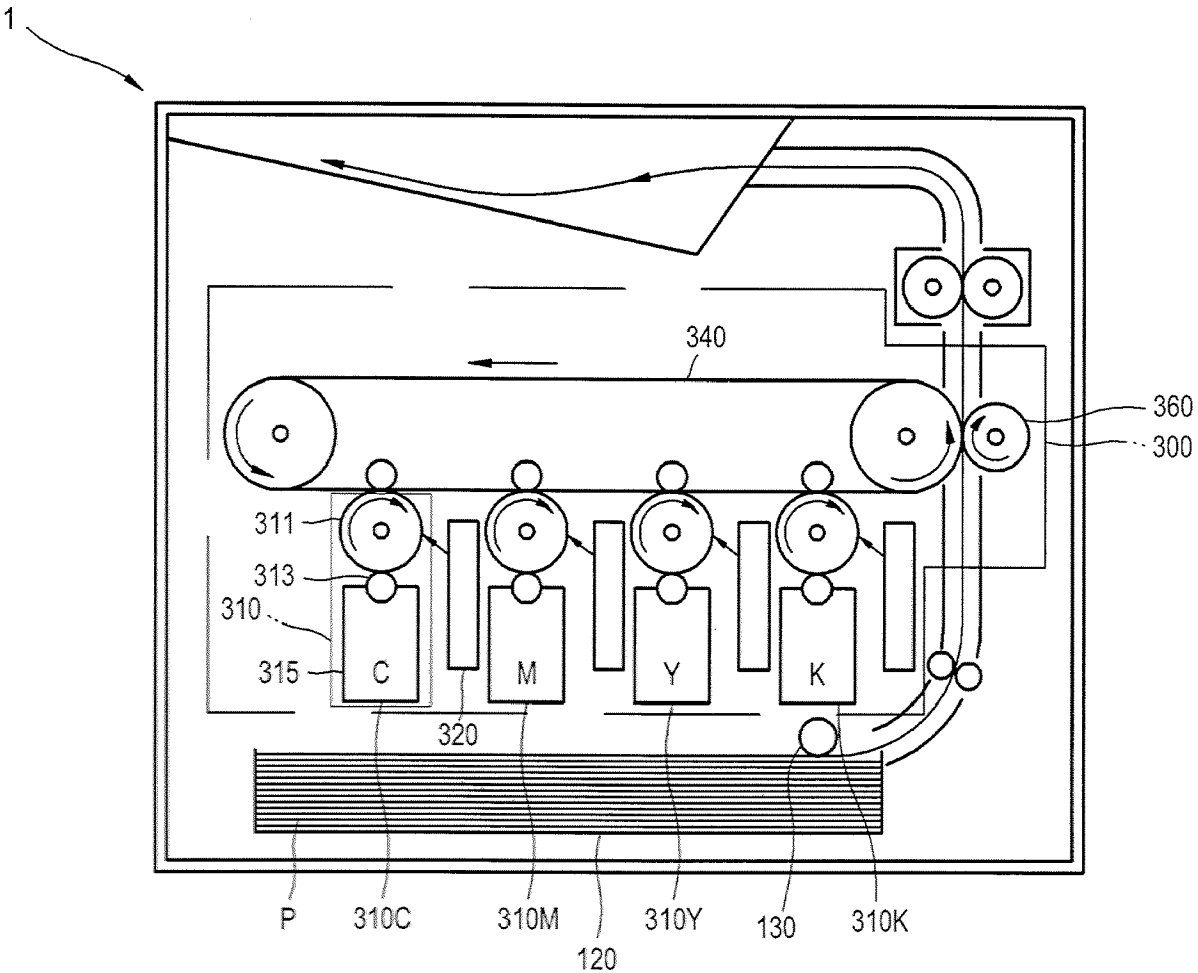
FIG. 3 schematically illustrates the image forming apparatus according to an exemplary embodiment of the present general inventive concept.

FIG. 2 is a block diagram illustrating a configuration of an image forming apparatus 1 according to an exemplary embodiment of the present general inventive concept, and FIG. 3 schematically illustrates the image forming apparatus 1 according to an exemplary embodiment of the present general inventive concept.

As illustrated therein, the image forming apparatus 1 according to an exemplary embodiment of the present general inventive concept includes an input unit 100 allowing a user to input a signal, a display unit 200 displaying an operation procedure of an image forming part 300, the image forming part 300 printing image data with a developer on a print medium; a developer remainder sensor 400 sensing the remainder of the developer in the image forming part 300, an image processor 500 converting image data into printing data or mono printing data according to the remainder of the developer, a communication unit 600 communicating with host systems h1 and h2 via communications network N, and a controller 700 controlling the image processor 500 according to sensing results of the developer remainder sensor 400.

The input unit 100 receives a user input for a printing request and a printing condition, and the display unit 200 displays the operation procedure of the image forming part 300. The input unit 100 and the display unit 200 may be provided as a graphic user interface (GUI) in the host systems h1 and h2 according to a control signal of the controller 700, or provided in the form of an input panel and a display panel in the image forming apparatus 1, respectively.

Further, if a driver corresponding to the image forming apparatus 1 is installed in the host systems h1 and/or h2, the input unit 100 and the display unit 200 may be activated by the driver.

The image forming part 300 applies the developer to the print medium (e.g., print medium P, located in print medium tray 120 and retrieved by print medium roller 130, as illustrated in FIG. 3), thereby forming an image. According to an exemplary embodiment of the present general inventive concept, the image forming part 300 includes a developing unit 310 storing the developer, an exposure unit 320 forming a latent image on a photosensitive body 311 of the developing unit 310, an intermediate transferring belt 340 to which the developer of the photosensitive body 311 is intermediately transferred, and a transfer roller 360 transferring a visible image from the intermediate transferring body 311 to the print medium.

The developing unit 310 includes the photosensitive body 311, a development roller 313 supplying the photosensitive body 311 with the developer, and a developer storage 315 where the developer is stored. The developing unit 310 may include developing unit 310C, developing unit 310M, developing unit 310Y, and developing unit 310K. For example, developing unit 310 C may contain cyan developer, developing unit 310 M may contain magenta developer, developing unit 310Y may contain yellow developer, and developing unit 310K may contain black developer.

The photosensitive body 311 applies the developer to the print medium P, thereby forming an image. The photosensitive body 311 may be formed by coating an outer surface of a cylindrical metal drum with a photoconductive material layer through a deposition or the like method. The photoconductive material layer forms the latent image corresponding to the image data thereon when exposed to light through the exposure unit 320. In addition, a charge roller (not illustrated) is provided in one side of the photosensitive body 311 and charges the surface of the photosensitive body 311 to have uniform electric potential.

The development roller 313 supplies the developer from a developer-feeding roller (not illustrated) to the latent image of the photosensitive body 311. At this time, a power supply (not illustrated) applies a development voltage to the development roller 313 in order to supply the developer from the surface of the development roller 313 to the photosensitive body 311. The development voltage is higher than a surface voltage that the surface of the photosensitive body 311 charged by the charge roller has, but lower than a surface voltage that the latent image exposed by the exposure unit 320. Thus, the developer on the surface of the development roller 313 is attached to the latent image of the photosensitive body 311 by difference in electric potential.

The developer storage 315 stores the developer therein. The developer storage 315 includes the developer-feeding roller (not illustrated) to supply the developer to the development roller 313, and an agitator (not illustrated) to agitate the developer.

Here, the developing unit 310 is provided in numbers corresponding to colors of the developer such as yellow Y (e.g., developing unit 310Y), magenta M (e.g., developing unit 310M), cyan C (e.g., developing unit 310C) and black K (e.g., developing unit 310K).

The exposure unit 320 scans light to the photosensitive body 311 according to the printing data transmitted from the image processor 500 (to be described later), thereby forming the latent image. The exposure unit 320 forms the latent image by a unit of a spot having a predetermined size corresponding to the size of a light source. The size of the spot (i.e., a printing dot) is determined depending on time how long the exposure unit 320 scans light to the photosensitive body 311.

The developer remainder sensor 400 senses a remainder of the developer stored in the developing unit 310, and informs the controller 700 of the remainder. The developer remainder sensor 400 is provided in the developer storage 315 of each developing unit 310, and senses the remainder of the developer in the developer storage 315 after the image data is completely printed. The developer remainder sensor 400 may be provided to check the remainder of the developer in the developing unit 310 in real-time, or to check when the remainder of the developer is lower than a predetermined low level, or perform any other suitable check.

To sense the remainder of the developer, the developer remainder sensor 400 may consider an accumulation number of printing dots, use a photo-sensor, or measure the weight of the developer storage 315.

The image processor 500 converts the image data into the printing data to be printable in the image forming part 300 when receiving a printing signal about the image data from the host system. Further, in the case of color image data, the image processor 500 may convert the color printing data into mono printing data of a reference color according to the control signal of the controller 700.

In general, the color image data is generated in the host systems h1 and h2 on the basis of the three primary colors of red, green and blue. To represent such image data with colors of developers, the image processor 500 converts the color image data into the color printing data based on four colors such as yellow Y, magenta M, cyan C and black K.

At this time, the color printing data is divided into four color printing data corresponding to each color of the developer. The image processor 500 transmits each color printing data as a pulse signal to the exposure unit 320. Here, the printing data is represented by a bit unit of a binary code, so that a gray scale of each color can be represented according to On/Off of the light source. For example, '1' of the printing data represents an On-signal of the light source, and '0' of the printing data represents an Off-signal of the light source.

FIG. 4A is a table illustrating an example of the color printing data. As illustrated therein, the color image data is converted into four color printing data corresponding to Y, M, C and K. The exposure unit 320 (illustrated in FIG. 3) receives each color printing data and turns on/off the light source in response to the pulse signal of the color printing data, thereby forming the latent image on the photosensitive body 311.

In the exposure unit 320, an exposure period corresponding to one pulse signal of the color printing data may have a default value according to a clock signal. The exposure time corresponding to one pulse signal determines the size of a reference printing dot. For example, as illustrated in FIG. 4A, the reference printing dots for all colors have the same size (i.e., Rc=Rm=Ry=Rk) since the pulse signals have one pulse width. Other exemplary dots sizes may include when the reference printing dots for all colors each have a different size, or at least one of the colors has a reference dot of a different size, or at least two of the colors has a reference dot of the same size.

When the controller 700 informs the image processor 500 that any one of colors of the developer remains less than the amount for printing the printing data, the image processor 500 converts the plurality of color printing data into the mono printing data of a mono color depending on print density.

The mono color may be one of colors of the developer that remains more than the amount for printing the printing data. If a plurality of colors of the developer remains more than the amount for printing the printing data, the mono color may be selected by a user or determined by default priority. For example, if black developer (e.g., from developing unit 310K) is sufficient, black developer may have priority over other colors of developer.

When the image processor 500 converts the plurality of color printing data into the mono printing data, the printing dots are changed in size according to colors, thereby representing various colors in the scale (e.g., gray scale) of the mono color. To this end, the image processor 500 adjusts the pulse width of the pulse signal corresponding to each color printing data. If the pulse width is adjusted, time taken to expose the photosensitive body 311 through the exposure unit 320 is changed, and thus the amount of developer applied to the latent image is also changed, thereby changing the size of the reference printing dot.

The pulse width of the pulse signal may be determined with respect to a reference color. For example, with regard to a typical pulse width for one among yellow, magenta, cyan and black, the pulse widths for the other colors may increase or decrease. The pulse signal may be adjusted on the basis of color density to be visually represented if yellow, magenta, cyan and black are printed out on the print medium. In other words, the pulse signal for black having a relatively high visual density may be adjusted to have the largest pulse width, and the pulse signal for yellow having a relatively low visual density may be adjusted to have the smallest pulse width. However, any other suitable pulse width adjustments for a reference color may be made.

Figure 4B:
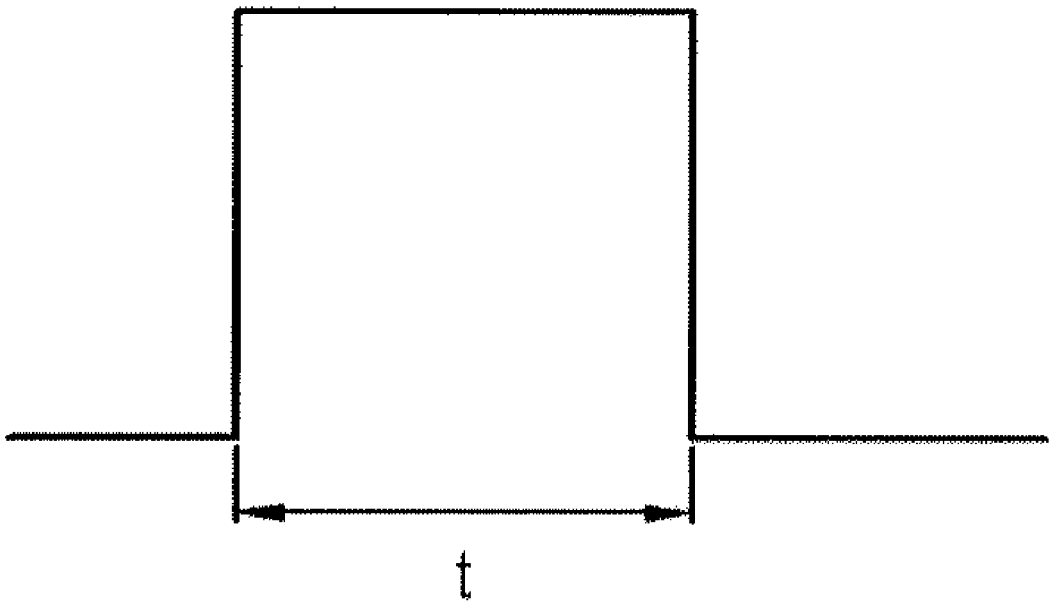

The image processor 500 illustrated in FIG. 2 may determine the pulse widths for the other colors with respect to black. Referring to FIGS. 4A and 4B, the image processor 500 decreases the pulse widths for cyan, magenta and yellow in sequence with respect to a pulse width t for black. Ratios of the pulse widths for the other colors to the pulse width for black may be determined as default values or selected by a user.

Figure 5A:
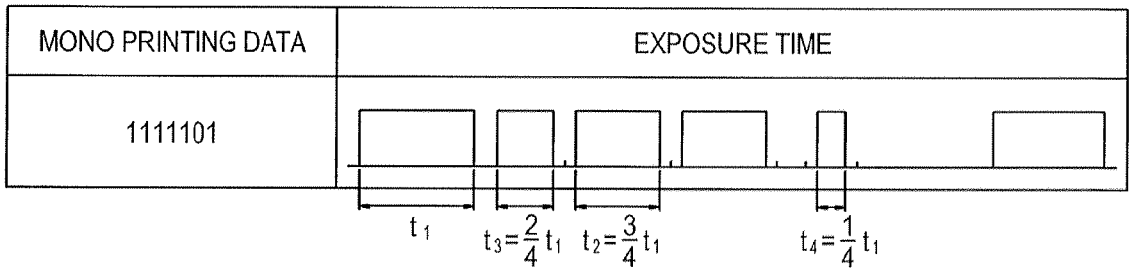
FIGS. 5A and 5B illustrate mono printing data generated in the image processor of the image forming apparatus according to an exemplary embodiment of the present general inventive concept.
Figure 5B:
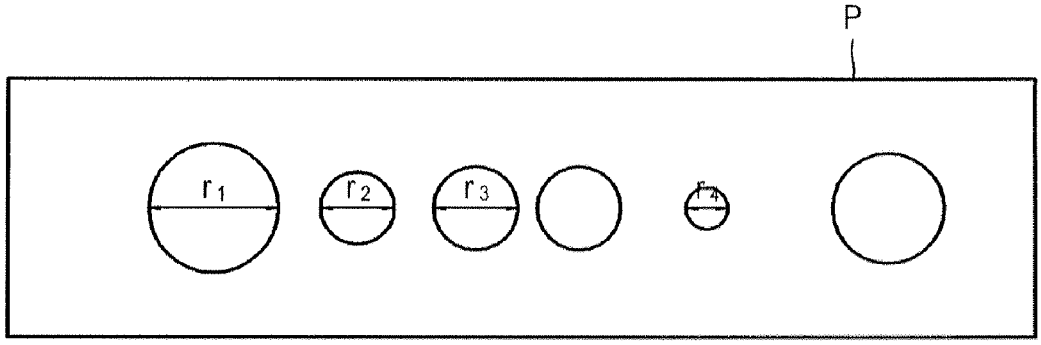

For example, FIG. 5A illustrates the mono printing data generated in the image processor 500, which represents the plurality of color printing data illustrated in FIG. 4A by various pulse widths such as, for example, t, (¾)t, (⅔)t, (¼)t for black, cyan, magenta and yellow, respectively. As the pulse width becomes shorter, the reference printing dots for respective colors are decreased in size (e.g., Rk>Rc>Rm>Ry) as illustrated in FIG. 5B.

If the reference printing dot is changed in size, the gray scale represented with the reference printing dots is seen to the naked eye as if it is changed even though the same number of printing dots are printed in the same area of the same print medium. In the example illustrated in FIGS. 5A and 5B, the pulse width t for black is quartered to represent four gray scales corresponding to four colors.

Figure 6:
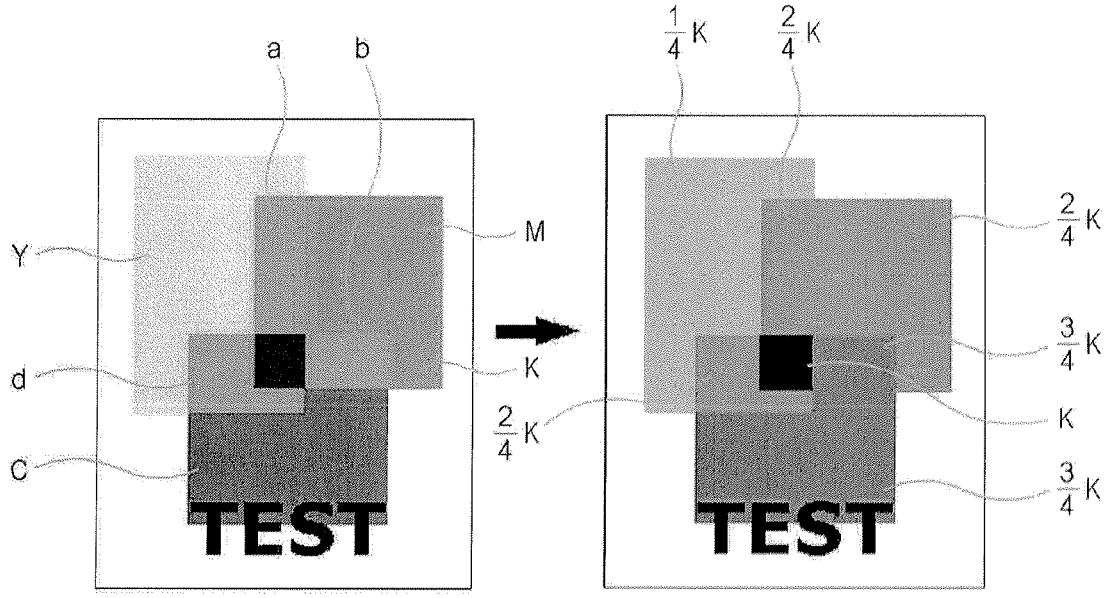
FIG. 6 illustrates printing results from the color printing data and the mono printing data.

FIG. 6 illustrated two printing results on the printing medium from the color printing data with colors of developer and from the mono printing data with black developer, in which the mono printing data is generated with four pulse widths divided with respect to the pulse width for black.

As illustrated therein, when the mono printing data is printed out, the gray scale is the thinnest in case of yellow Y and gets darker in order of magenta M and cyan C. In the meantime, a mixed color a of yellow Y and magenta M may be represented in the color printing. Such mixed colors a, b and d can be represented with colors of developer in the color printing, but not represented as the gray scales in the mono printing. The gray scales generally cannot represent the mixed colors a, b and d because the pulse width t for black is quartered to correspond to four colors and thus only four gray scales may be used in the mono printing.

To compensate the gray scales for the mono printing, the image processor 500 may divide the pulse width t into eight parts, sixteen parts, or any other suitable number of parts (e.g., more than four parts when there are four colors used such as C, M, Y, and K). In other words, the gray scales of mono color may represent four colors, eight colors or sixteen colors according to how many parts the pulse width of the pulse signal is divided into when the color printing data is converted into the mono printing data. The more parts the pulse width is divided into, the more colors such as mixed colors the gray scales of the mono color can represent. The pulse signal of the mono printing data may be divided as many as a multiple of the plural developing units 310 and can be divided into, for example, 256 parts.

In this example, the pulse width t for black is quartered and the pulse widths for the other colors are decreased in sequence with respect to the quartered pulse width, so that yellow, magenta and cyan can be represented with '¼,' '⅔' and '¾' densities of black, respectively. At this time, the mixed color between yellow and magenta is represented with the '⅔' density of black; the mixed color between yellow and cyan or between cyan and magenta is represented with the '¾' density of black; and the mixed color of yellow, magenta and cyan is represented with the same density with black. Thus, such mixed colors are not distinctive as illustrated in FIG. 6.

In another example, if the pulse width t for black is divided into eight parts and the pulse widths for the other colors are decreased in sequence with respect to the divided pulse width, yellow, magenta and cyan may be represented with '⅜,' '⅝,' and '⅞' densities of black, respectively. The mixed color between yellow and magenta is represented with a '⅜' density of black, the mixed color between yellow and cyan is represented with the '⅝' density of black, the mixed color between cyan and magenta is represented with a '⅝' density of black, and the mixed color of yellow, magenta and cyan is represented with the same density with black. Thus, such mixed colors are partially distinctive.

In an exemplary embodiment, the pulse widths for the other colors may be decreased in sequence with respected to the pulse width for black, thereby adjusting the size of the reference printing dot. Alternatively, to adjust the size of the reference printing dot, the pulse widths for the other colors may be decreased in sequence with respect to the pulse width for yellow.

The controller 700 illustrated in FIG. 3 controls the image processor 500 to convert the color printing data into the mono printing data according to the sensing results of the developer remainder sensor 400, and the image forming part 300 to print the mono printing data with mono color.

The image processor 500 may convert the color image data into the color printing data, and if the developer remainder sensor 400 senses that any one of colors of developer remains less than the amount for the color printing, the controller 700 controls the display unit 200 to display that the remainder of the developer is insufficient. Further, the controller 700 controls the display unit 200 to display a predetermined interface for receiving an input about whether or not to print the color image data with the mono color that sufficiently remains more than the amount for the mono printing.

Image forming apparatus 1 illustrated in FIGS. 2 and 3 may receive a user selection of color image data to be printed with the mono color. The controller 700 controls the image processor 500 to convert the color printing data to the mono printing data, and the image forming part 300 to form an image based on the mono printing data.

If a plurality of colors of developer each remain more than the predetermined amount for the mono printing, the controller 700 receive a selection from a user for the mono color for the mono printing. Further, the controller 700 may perform the mono printing with the most remained developer or with a default color.

Figure 7:
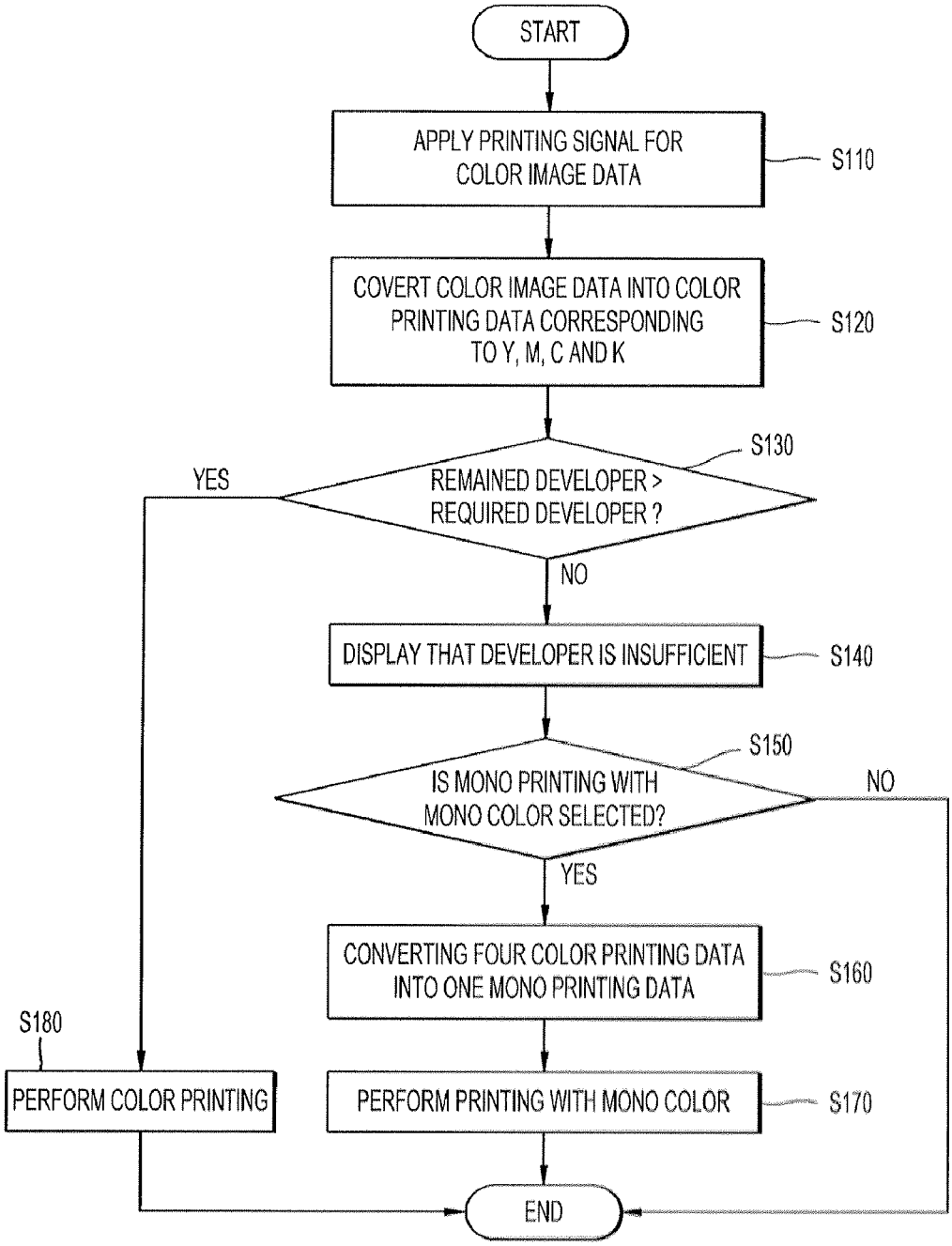
FIG. 7 illustrates a flowchart of an image forming method in the image forming apparatus according to an exemplary embodiment of the present general inventive concept.

An image forming method of the image forming apparatus according to an exemplary embodiment of the present general inventive concept will be described with reference to FIG. 7.

At operation S110, the image forming apparatus receives the image data contained in the printing signal from the plurality of host systems h1 and h2. The image processor 500 converts the image data into the printing data in the order of the received printing signals, or in any other suitable order. In case of the color image data, the color printing data is generated according to colors at operation S120. The printing data and the color printing data are put on stand-by for the printing of the image forming part 300.

The developer remainder sensor 400 senses the remainder of each color of the developer whenever the image forming part 300 completely prints the image data. At operation S130, the developer remainder sensor 400 compares the amount of developed for printing the stand-by printing data with the remainder of the developer, and determines whether the remainder of the developer is less than the amount of developer to print the image. If the remaining developer is greater than or equal to the amount of developer to print the image, the image is printed at operation S180.

If the color printing data is put on stand-by for the printing, the developer remainder sensor 400 senses the remainder with respect to all colors of developer. Alternatively, the developer remainder sensor may sense the remainder for one or more colors of developer. If any one of colors of developer is insufficient, the developer remainder sensor 400 informs the controller 700 that any one of colors of the developer is insufficient.

At operation S140, the controller 700 controls the image forming apparatus 1 or the host system h1, h2 to display a message that any one of colors of developer is insufficient. At operation S150, the controller 700 receives a user's input about whether or not to print the color image data with the mono color developer that sufficiently remains for the mono printing. If a user does not want the mono color printing, the controller 700 cancels this color printing data and starts printing the next standby printing data. If the next standby printing data is also the color printing data, the controller 700 undergoes the same foregoing procedures and receives a user's input about whether or not to print the color image data with the mono color developer.

If a user selects the mono color printing, at operation S160 the controller 700 controls the image processor 500 to convert the plurality of color printing data into the mono printing data. The image processor 500 generates the mono printing data different in the pulse width according to colors, and the exposure unit 320 forms a latent image on the photosensitive body 311 according to the generated mono printing data.

At operation S160, the developing unit 310 forms a visible image based on the latent image with the sufficient mono color developer which is selected by a user or determined by the controller 700, and the visual image is printed on the print medium at operation S170 via an intermediate transfer roller 640 and a transfer roller 360. At this time, various pulse widths represent various sizes of the reference printing dots, and the density of the image printed on the print medium is different according to colors, thereby representing various gray scales.

In the above-described embodiment, the present general inventive concept is applied to a single-pass type image forming apparatus that includes the developing units and the exposure units provided corresponding to colors, but not limited thereto. Alternatively, the present general inventive concept may be applied to a multi-pass type image forming apparatus that includes a plurality of developing units and one exposure unit.

As described above, the present general inventive concept provides an image forming apparatus and an image forming method thereof, in which, if any one of colors of developer is insufficient after preparing color printing data, the prepared color printing data is converted into mono printing data, thereby preventing wasteful occupation in the memory. Further, there is no need of canceling the color printing data and transmitting a printing signal for the mono printing data, thereby providing convenience to a user.

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

Although a few exemplary embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A method of forming an image with a plurality of colors of developer, the method comprising:

generating color printing data corresponding to colors including a reference color;

sensing remainders of the plurality of colors of developer;

converting the color printing data into mono printing data using the reference color of developer if at least one of colors of developer other than the reference color is insufficient; and printing the mono printing data, wherein a dot size of the mono printing data for the reference color is different from a dot size of the mono printing data for the at least one of colors of the insufficient developer.

2. The method according to claim 1, wherein the converting the color printing data into the mono printing data comprises dividing a pulse signal of each color printing data with respect to the pulse signal of the reference color.

3. The method according to claim 2, wherein the pulse signal of the color printing data is divided by as many as a multiple of the plurality of colors of developer.

4. The method according to claim 3, further comprising converting the pulse signal of each color of developer into one of the divided pulse signals such that the plurality of colors of developer have one or more different pulse signals.

5. The method according to claim 4, wherein the mono printing data is converted to have the pulse signal decreased in an order of black, cyan, magenta and yellow.

6. The method according to claim 3, wherein the higher multiple the divided pulse signals correspond to, the more colors the mono printing data represents.

7. The method according to claim 6, further comprising displaying a multiple for dividing the pulse signal.

8. The method according to claim 7, further comprising changing the multiple for dividing the pulse signal.

9. An image forming apparatus comprising:

a plurality of developing units which correspond to different colors of developer and have a photosensitive body and a developer storage to form an image on a print medium;

a developer remainder sensor to sense a remainder of each color of developer in each one of the developing units;

an image processor to convert color image data of a printing signal into a plurality of color printing data to be printable, and to convert the plurality of color printing data into mono printing data for mono color corresponding to a reference color;

a light scanning unit to scan the photosensitive body with light according to printing data generated by the image processor; and a controller to control the image processor to convert the color printing data into mono printing data using the reference color of developer if the developer remainder sensor senses that the remainder of developer other than the reference color in at least one of the developer units is insufficient, wherein a dot size of the mono printing data for the reference color is different from a dot size of the mono printing data for the at least one of colors of the insufficient developer.

10. The apparatus according to claim 9, wherein the image processor adjusts a pulse signal of the color printing data to have different print densities for colors when the plurality of color printing data is converted into mono printing data for a reference color.

11. The apparatus according to claim 10, wherein the image processor converts the mono printing data to have various pulse signals with respect to a pulse signal for a reference color.

12. The apparatus according to claim 11, wherein the pulse signal is decreased in an order of black, cyan, magenta and yellow.

13. The apparatus according to claim 11, wherein the pulse signal is divided by as many as a multiple of the plurality of colors of developer.

14. An image forming apparatus, comprising:

a sensor to sense a first amount of a first color developer and a second amount of a second color developer, one of the first color developer and the second color developer corresponding to a reference color;

a controller to convert color print data to mono print data using the reference color according to at least one of the first amount and the second amount; and a developing unit to form an image corresponding to the mono print data on a print media using the reference color of the first color developer and the second color developer, wherein a dot size of the mono printing data for the reference color is different from a dot size of the mono printing data for the other one of the first color developer and the second color developer.

15. The image forming apparatus of claim 14, wherein the controller receives the color print data from an external host device, and converts the color print data into mono print data without communicating with the external host device.

16. A method of forming an image, the method comprising:

sensing a first amount of a first color developer and a second amount of a second color developer, one of the first color developer and the second color developer corresponding to a reference color;

converting color print data to mono print data using the reference color according to at least one of the first amount and the second amount; and forming an image on a print media using the reference color of the first color developer and the second color developer, wherein a dot size of mono printing data for the reference color is different from a dot size of mono printing data for the other one of the first color developer and the second color developer.

17. The method of claim 16, further comprising:

receiving the color part data from an external host device; and converting the color print data into mono print data without communicating with the external host device.

* * * * *